US011155950B2

(12) United States Patent
Jia

(10) Patent No.: US 11,155,950 B2
(45) Date of Patent: Oct. 26, 2021

(54) FABRIC FOR SWEAT WICKING PAJAMAS AND UNDERCLOTHING AND PREPARING METHOD THEREOF

(71) Applicant: Shanghai Xiaolanxiang Garment Co., Ltd., Shanghai (CN)

(72) Inventor: Youbing Jia, Shanghai (CN)

(73) Assignee: SHANGHAI XIAOLANXIANG GARMENT CO., LTD., Shanghai (CN)

( * ) Notice: Subject to any disclaimer, the term of this patent is extended or adjusted under 35 U.S.C. 154(b) by 94 days.

(21) Appl. No.: 16/600,592

(22) Filed: Oct. 14, 2019

(65) Prior Publication Data

US 2021/0054553 A1 Feb. 25, 2021

(30) Foreign Application Priority Data

Aug. 21, 2019 (CN) ..... 201910771991.6

(51) Int. Cl.
*D06C 9/02* (2006.01)
*D06C 27/00* (2006.01)
*D06C 29/00* (2006.01)

(52) U.S. Cl.
CPC ..... *D06C 9/02* (2013.01); *D06C 27/00* (2013.01); *D06C 29/00* (2013.01)

(58) Field of Classification Search
CPC ... D06C 9/02; D06C 9/00; D06C 9/04; D06C 27/00; D06C 29/00; D06M 13/342; D06M 13/513; D06M 2101/06; D06M 2101/38; D06M 15/53; D06M 15/03; D06M 13/419; D06M 11/155; D06B 3/105; D06B 3/10; D06B 3/00; D06B 7/08; D06B 7/10; D06B 19/00; D06B 19/0005; D06B 19/0011; D06B 19/0017; D06B 21/00; D06B 2700/36; D03D 1/00; D03D 1/0017; D03D 15/20; D03D 15/208; D03D 15/217; D03D 15/50
See application file for complete search history.

(56) References Cited

U.S. PATENT DOCUMENTS

| | | | | | |
|---|---|---|---|---|---|
| 4,863,775 | A * | 9/1989 | Jacobs | D06C 13/00 | 428/91 |
| 5,745,966 | A * | 5/1998 | Osthoff | D06C 5/00 | 26/3 |
| 2014/0352073 | A1* | 12/2014 | Goenka | D06N 3/08 | 5/691 |
| 2015/0259843 | A1* | 9/2015 | Goenka | D06B 21/00 | 264/103 |
| 2019/0309452 | A1* | 10/2019 | Liao | D04B 1/18 | |
| 2020/0056309 | A1* | 2/2020 | Gupta | D03D 13/008 | |

FOREIGN PATENT DOCUMENTS

| | | | |
|---|---|---|---|
| CN | 102080293 | A * | 6/2011 |
| CN | 202247147 | U * | 5/2012 |
| CN | 103510239 | A * | 1/2014 |
| CN | 103668697 | A * | 3/2014 |
| CN | 103882603 | A | 6/2014 |
| CN | 106367875 | A * | 2/2017 |
| CN | 107904744 | A | 4/2018 |
| CN | 108625150 | A * | 10/2018 |
| CN | 108859342 | A * | 11/2018 |
| CN | 109505045 | A | 3/2019 |

* cited by examiner

*Primary Examiner* — Amy Vanatta
(74) *Attorney, Agent, or Firm* — Bayramoglu Law Offices LLC

(57) ABSTRACT

A method of preparing a fabric for perspiration exhaust pajamas and underclothing includes the following steps: (1) grey cloth weaving: weaving a perspiration exhaust fiber, a regenerated cellulose fiber, and spandex into a grey cloth; (2) singeing: singeing the grey cloth to obtain a singed grey cloth through a two-face-two-back singeing; and (3) moisture adsorption and perspiration exhaust finishing: immersing the singed grey cloth in a finishing liquid, taking out the singed grey cloth for drying, baking, washing, and then drying to a constant weight to obtain the fabric for perspiration exhaust pajamas and underclothing.

10 Claims, No Drawings

FABRIC FOR SWEAT WICKING PAJAMAS AND UNDERCLOTHING AND PREPARING METHOD THEREOF

CROSS REFERENCE TO THE RELATED APPLICATIONS

This application is based upon and claims priority to Chinese Patent Application No. 201910771991.6, filed on Aug. 21, 2019, the entire contents of which are incorporated herein by reference.

TECHNICAL FIELD

The present invention relates to a technical field of textile products, and particularly to a fabric for sweat wicking pajamas and underclothing and a preparing method thereof.

BACKGROUND

Recently, with the improvement in people's living standard and the rapid development of the garment industry, consumers require the garments not only can keep warm and cover the body, but also have a pleasant looking, good wearing comfort and good inner quality. The wearing comfort has gradually become a major consideration for consumers when they choose the garment.

Cotton-based garments are particularly popular in the garment market. However, since the cotton fiber has a good hygroscopicity, in the case of excessive sweating, the cloth absorbs a large amount of sweat to become wet and heavy and sticks to the skin, resulting in reduction in a moisture permeability speed and a desorbing speed. Moreover, since the cotton fiber swells after absorbing moisture and the pores between the cotton fibers are blocked, the transmission of sweat and sweat gas between the fibers becomes more difficult, and the microclimate between the skin and the garment and the exchange of heat and moisture between the garment and the external environment are affected, thereby producing a stuffy feeling. Therefore, the cotton fiber is not appropriate to prepare a moisture absorbing and sweat wicking fabric.

Coolmax fiber is a functional fiber developed by Du Pont company of United States in 1986. The Coolmax fiber has a flat cross-shaped cross section, so its surface forms four grooves, i.e., four sweat wicking tubes. The flat four-groove structure allows adjacent fibers to be easily brought together to form a plurality of fine wicking tubes with a strong capillary effect, and thus has a function of quickly discharging the sweat to the surface of the cloth. At the same time, a specific surface area of the fiber is 19.8% larger than that of the general circular cross-section fiber with the same fineness, and thus, the sweat can be quickly evaporated into the surrounding atmosphere after being discharged to the surface of the fiber cloth. Such a fiber has an excellent gas permeability since the irregular cross section thereof provides a large gap between the fibers, and as a result, the fiber cloth has an excellent moisture permeability due to the structure of the Coolmax fiber.

At present, a method of improving the moisture absorbing and sweat wicking property of the fiber cloth with a finishing technique has a relatively low cost and relatively simple process, which mainly uses some special chemical additives to perform the functional finishing of the cloth so that the cloth has the moisture absorbing and sweat wicking property, but there is a problem of poor durability. At present, the research on the sweat wicking finishing of cloth is mainly focused on a finishing agent which mainly comprises a hydrophilic additive for the purpose of improving the moisture absorbing and sweat wicking property of the fabric and improving the wearing comfort of the cloth.

In light of the above technical problems, the present invention is to develop a fabric for sweat wicking pajamas and underclothing to meet people's requirements on a multi-functional fabric.

SUMMARY

In light of the disadvantages in the conventional art, the technical problem to be solved by the present invention is to provide a fabric for sweat wicking pajamas and underclothing and a preparing method thereof. The fabric for sweat wicking pajamas and underclothing, which is made of a sweat wicking fiber and a regenerated cellulose fiber and prepared by performing a moisture absorbing and sweat wicking finishing, has remarkable hygroscopicity and moisture permeability, and good durability, wash resistance and moisture absorbing and sweat wicking property, thereby keeping the skin dry, reducing sticking of a cloth to a human body, improving the sensitivity to cold, and significantly improving a wearing comfort.

The object of the present invention is achieved by the following technical scheme:

A preparing method of a fabric for sweat wicking pajamas and underclothing comprises:

(1) grey cloth weaving: weaving a sweat wicking fiber 0-100 parts by weight, a regenerated cellulose fiber 0-100 parts by weight, and spandex 0-100 parts by weight into grey cloth by a conventional method;

(2) singeing: singeing the grey cloth to obtain singed grey cloth through two-face-two-back singeing under the condition that a cloth speed is 80-100 m/min, a distance between the grey cloth and a reducing flame is 1-1.2 cm, a distance between the grey cloth and a copper plate is 0.5-0.8 cm, a distance between the grey cloth and a cylinder is 5-7 cm, and a singeing grade is 4-5 grades; and (3) moisture absorbing and sweat wicking finishing: immersing the singed grey cloth in a finishing liquid for 25-35 minutes at a temperature of 20-30° C. and at a mass ratio of 1:(10-20) which is a mass ratio of the singed grey cloth to the finishing liquid, drying the singed grey cloth taken out at 90-110° C. for 4-8 minutes, baking at 140-160° C. for 100-150 seconds, washing at room temperature for 1-3 times, and then drying at 60-80° C. to constant weight to obtain the fabric for sweat wicking pajamas and underclothing.

Preferably, a preparing method of the fabric for sweat wicking pajamas and underclothing comprises:

(1) grey cloth weaving: weaving a sweat wicking fiber 10-100 parts by weight, a regenerated cellulose fiber 10-100 parts by weight, and spandex 0-30 parts by weight into grey cloth by a conventional method;

(2) singeing: singeing the grey cloth to obtain singed grey cloth through two-face-two-back singeing under the condition that a cloth speed is 80-100 m/min, a distance between the grey cloth and a reducing flame is 1-1.2 cm, a distance between the grey cloth and a copper plate is 0.5-0.8 cm, a distance between the grey cloth and a cylinder is 5-7 cm, and a singeing grade is 4-5 grades;

(3) pretreatment: immersing the singed grey cloth in a pretreatment liquid for 25-35 minutes at a temperature of 28-32° C. and at a mass ratio of 1:(10-20) which is a mass ratio of the singed grey cloth to the pretreatment liquid, drying the singed grey cloth taken out at 60-80° C. to constant weight to obtain a pretreatment fabric; and (4) moisture absorbing and sweat wicking finishing: immersing the pretreatment fabric in a finishing liquid for 25-35 minutes at a temperature of 20-30° C. and at a mass ratio of 1:(10-20) which is a mass ratio of the pretreatment fabric to the finishing liquid, drying the pretreatment fabric taken out at 90-110° C. for 4-8 minutes, baking at 140-160° C. for 100-150 seconds, washing at room temperature for 1-3 times, and then drying at 60-80° C. to constant weight to obtain the fabric for sweat wicking pajamas and underclothing.

The pretreatment liquid is prepared by the following method: mixing inorganic salt 1-3 parts by weight, glycine 0.2-0.4 parts by weight, acetic acid 0.8-1.2 parts by weight and water 90-100 parts by weight, and stirring at 100-300 rpm/min and 28-32° C. for 8-12 minutes to obtain the pretreatment liquid.

The inorganic salt is magnesium chloride and/or calcium chloride.

Preferably, the inorganic salt is a mixture of magnesium chloride and calcium chloride, and a mass ratio of magnesium chloride to calcium chloride is (1-5):1.

The finishing liquid comprises penetrating agent 0.2-0.6 parts by weight, moisture absorbing and sweat wicking finishing agent 2-4 parts by weight, xanthan gum or modified xanthan gum 0.4-0.8 parts by weight, and water 90-100 parts by weight.

The penetrating agent is one or two of coconut oil diethanolamine amide and isooctanol polyethenoxy ether.

The modified xanthan gum is prepared by the following method: obtaining neutralized acrylic acid by mixing acrylic acid 10-15 g and 4-6 mol/L sodium hydroxide solution 0.8-1.3 g and stirring at 100-200 rpm/min for 3-5 minutes, adding xanthan gum 0.8-1.2 g to water 120-150 mL, stirring at 100-200 rpm/min and 20-30° C. for 40-60 minutes, adding the neutralized acrylic acid, acrylamide 10-15 g and cross-linking agent 0.2-0.4 g, stirring at 100-200 rpm/min while warming to a temperature of 65-75° C. in a nitrogen atmosphere, adding dropwise 5-10 wt % potassium persulfate solution 4-8 g within 20-40 minutes, stirring at 100-200 rpm/min and 65-75° C. for 2-4 hours, then adding ethanol 600-800 mL, stirring at 40-100 rpm/min for 3-5 minutes, standing at 20-30° C. for 1-3 hours and filtrating, washing an obtained filter cake with 75-85 volume % ethanol for 1-3 times, drying at 40-60° C. to constant weight, and pulverizing and passing through a 40-80 mesh sieve to obtain the modified xanthan gum.

The cross-linking agent is one or more of allyl glycidyl ether, 3-glycidoxypropyltrimethoxysilane and trimethylolpropane triglycidyl ether.

Preferably, the cross-linking agent is allyl glycidyl ether.

The sweat wicking fiber is one or more of Coolmax fiber, Coolpass fiber and Porel fiber, the regenerated cellulose fiber is one or more of Modal fiber, Tencel fiber, bamboo fiber and cuprammonium rayon, and the spandex is one or two of Lycra and Mobilon.

A fabric for sweat wicking pajamas and underclothing is prepared by a preparing method of the fabric for sweat wicking pajamas and underclothing according to the prevent invention.

The present invention relates to a fabric for sweat wicking pajamas and underclothing and a preparing method thereof. The fabric for sweat wicking pajamas and underclothing, which is made of a sweat wicking fiber and a regenerated cellulose fiber and prepared by performing a moisture absorbing and sweat wicking finishing, has remarkable hygroscopicity and moisture permeability, and good durability, wash resistance and moisture absorbing and sweat wicking property, thereby keeping the skin dry, reducing sticking of a cloth to a human body, improving the sensitivity to cold, and significantly improving a wearing comfort.

DETAILED DESCRIPTION OF THE EMBODIMENTS

In the present invention, unless otherwise specified, all equipment and raw materials are commercially available or commonly used in the industry, and unless otherwise specified, the methods in the following examples are conventional methods in this field.

Coolmax fiber, produced by INVISTA company, 1.3D.

Bamboo fiber, using Rio Bamboo® fiber i.e., the Lyocell bamboo fiber produced by Shanghai Leo Fiber Enterprise Development Co., Ltd.

Spandex, using DuPont Lycra spandex filament, 20D.

Moisture absorbing and sweat wicking agent, using the moisture absorbing and sweat wicking agent produced by 3M Scotchgard Company of United States, model number: FC-226.

Glycine, purchased from Shanghai Baoman Biotechnology Co., Ltd.

Magnesium chloride, anhydrous magnesium chloride purchased from Shanghai Macklin Biochemical technology Co., Ltd.

Calcium chloride, anhydrous calcium chloride purchased from Shanghai Macklin Biochemical technology Co., Ltd.

Xanthan gum, purchased from Shanghai Macklin Biochemical technology Co., Ltd.

Coconut oil diethanolamine amide, purchased from Shanghai Macklin Biochemical technology Co., Ltd., model number: 6501.

Acrylic acid, purchased from Shanghai Macklin Biochemical technology Co., Ltd.

Acrylamide, purchased from Shanghai Aladdin Biochemical technology Co., Ltd.

Allyl glycidyl ether, purchased from Shanghai Macklin Biochemical technology Co., Ltd.

3-glycidoxypropyltrimethoxysilane, purchased from Hangzhou Dadi Chemical Co., Ltd.

Trimethylolpropane triglycidyl ether, purchased from Shanghai Yuanye Biotechnology Co., Ltd.

Embodiment 1

A preparing method of a fabric for sweat wicking pajamas and underclothing comprises:

(1) grey cloth weaving: blending Coolmax fiber 35 parts by weight and bamboo fiber 50 parts by weight to obtain a blended yarn, and then weaving the blended yarn and spandex 15 parts by weight with a circular loom to obtain the fabric which is a double-sided cloth with a weight of 200 $g/m^2$;

(2) singeing: singeing the grey cloth to obtain singed grey cloth through two-face-two-back singeing under the condition that a cloth speed is 90 m/min, a distance between the grey cloth and a reducing flame is 1.2 cm, a distance between the grey cloth and a copper plate is 0.6 cm, a distance between the grey cloth and a cylinder is 6 cm, and a singeing grade is 5 grades; and (3) moisture absorbing and sweat wicking finishing: immersing the singed grey cloth in a finishing liquid for 30 minutes at a temperature of 25° C. and at a mass ratio of 1:15 which is a mass ratio of the singed grey cloth to the finishing liquid, drying the singed grey cloth taken out at 100° C. for 6 minutes, baking at 150° C. for 120 seconds, washing twice at room temperature, and then drying at 70° C. to constant weight to obtain the fabric for sweat wicking pajamas and underclothing.

The finishing liquid is prepared by the following method: adding penetrating agent 0.4 parts by weight, moisture absorbing and sweat wicking finishing agent 3 parts by weight, xanthan gum 0.6 parts by weight and water 96 parts by weight to the water, and stirring at 200 rpm/min and 25° C. for 10 minutes.

The penetrating agent is coconut oil diethanolamine amide.

Embodiment 2

A preparing method of a fabric for sweat wicking pajamas and underclothing comprises: (1) grey cloth weaving: blending Coolmax fiber 35 parts by weight and bamboo fiber 50 parts by weight to obtain a blended yarn, and then weaving the blended yarn and spandex 15 parts by weight with a circular loom to obtain the fabric which is a double-sided cloth with a weight of 200 g/m$^2$;

(2) singeing: singeing the grey cloth to obtain singed grey cloth through two-face-two-back singeing under the condition that a cloth speed is 90 m/min, a distance between the grey cloth and a reducing flame is 1.2 cm, a distance between the grey cloth and a copper plate is 0.6 cm, a distance between the grey cloth and a cylinder is 6 cm, and a singeing grade is 5 grades; and (3) moisture absorbing and sweat wicking finishing: immersing the singed grey cloth in a finishing liquid for 30 minutes at a temperature of 25° C. and at a mass ratio of 1:15 which is a mass ratio of the singed grey cloth to the finishing liquid, drying the singed grey cloth taken out at 100° C. for 6 minutes, baking at 150° C. for 120 seconds, washing twice at room temperature, and then drying at 70° C. to constant weight to obtain the fabric for sweat wicking pajamas and underclothing.

The finishing liquid is prepared by the following method: adding penetrating agent 0.4 parts by weight, moisture absorbing and sweat wicking finishing agent 3 parts by weight, modified xanthan gum 0.6 parts by weight, and water 96 parts by weight to the water, and stirring at 200 rpm/min and 25° C. for 10 minutes.

The penetrating agent is coconut oil diethanolamine amide.

The modified xanthan gum is prepared by the following method: obtaining neutralized acrylic acid by mixing acrylic acid 12 g and 5 mol/L sodium hydroxide solution 1.1 g and stirring at 150 rpm/min for 4 minutes, adding xanthan gum 1 g to water 140 mL, stirring at 150 rpm/min and 25° C. for 50 minutes, adding the neutralized acrylic acid, acrylamide 12 g and cross-linking agent 0.3 g, stirring at 150 rpm/min while warming to a temperature of 70° C. in a nitrogen atmosphere, adding dropwise 8 wt % potassium persulfate solution 6 g within 30 minutes, stirring at 150 rpm/min and 70° C. for 3 hours, then adding ethanol 700 mL, stirring at 60 rpm/min for 4 minutes, standing at 25° C. for 2 hours and filtrating with a 500 mesh filter cloth, washing an obtained filter cake with 80 volume % ethanol twice, drying at 50° C. to constant weight, and pulverizing and passing through a 60 mesh sieve to obtain the modified xanthan gum.

The cross-linking agent is allyl glycidyl ether.

Comparative Example 1

The first comparative example is substantially the same as the second example except that the modified xanthan gum is prepared by the following method: obtaining neutralized acrylic acid by mixing acrylic acid 12 g and 5 mol/L sodium hydroxide solution 1.1 g and stirring at 150 rpm/min for 4 minutes, adding xanthan gum 1 g to water 140 mL, stirring at 150 rpm/min and 25° C. for 50 minutes, adding the neutralized acrylic acid and acrylamide 12 g, stirring at 150 rpm/min while warming to a temperature of 70° C. in a nitrogen atmosphere, adding dropwise 8 wt % potassium persulfate solution 6 g within 30 minutes, stirring at 150 rpm/min and 70° C. for 3 hours, then adding ethanol 700 mL, stirring at 60 rpm/min for 4 minutes, standing at 25° C. for 2 hours and filtrating with a 500 mesh filter cloth, washing an obtained filter cake with 80 volume % ethanol twice, drying at 50° C. to constant weight, and pulverizing and passing through a 60 mesh sieve to obtain the modified xanthan gum.

Embodiment 3

A preparing method of a fabric for sweat wicking pajamas and underclothing comprises:

(1) grey cloth weaving: blending Coolmax fiber 35 parts by weight and bamboo fiber 50 parts by weight to obtain a blended yarn, and then weaving the blended yarn and spandex 15 parts by weight with a circular loom to obtain the fabric which is a double-sided cloth with a weight of 200 g/m$^2$;

(2) singeing: singeing the grey cloth to obtain singed grey cloth through two-face-two-back singeing under the condition that a cloth speed is 90 m/min, a distance between the grey cloth and a reducing flame is 1.2 cm, a distance between the grey cloth and a copper plate is 0.6 cm, a distance between the grey cloth and a cylinder is 6 cm, and a singeing grade is 5 grades; and (3) moisture absorbing and sweat wicking finishing: immersing the singed grey cloth in a finishing liquid for 30 minutes at a temperature of 25° C. and at a mass ratio of 1:15 which is a mass ratio of the singed grey cloth to the finishing liquid, drying the singed grey cloth taken out at 100° C. for 6 minutes, baking at 150° C. for 120 seconds, washing twice at room temperature, and then drying at 70° C. to constant weight to obtain the fabric for sweat wicking pajamas and underclothing.

The finishing liquid is prepared by the following method: adding penetrating agent 0.4 parts by weight, moisture absorbing and sweat wicking finishing agent 3 parts by weight, modified xanthan gum 0.6 parts by weight, and water 96 parts by weight to the water, and stirring at 200 rpm/min and 25° C. for 10 minutes.

The penetrating agent is coconut oil diethanolamine amide.

The modified xanthan gum is prepared by the following method: obtaining neutralized acrylic acid by mixing acrylic acid 12 g and 5 mol/L sodium hydroxide solution 1.1 g and stirring at 150 rpm/min for 4 minutes, adding xanthan gum 1 g to water 140 mL, stirring at 150 rpm/min and 25° C. for 50 minutes, adding the neutralized acrylic acid, acrylamide 12 g and cross-linking agent 0.3 g, stirring at 150 rpm/min while warming to a temperature of 70° C. in a nitrogen atmosphere, adding dropwise 8 wt % potassium persulfate solution 6 g within 30 minutes, stirring at 150 rpm/min and 70° C. for 3 hours, then adding ethanol 700 mL, stirring at 60 rpm/min for 4 minutes, standing at 25° C. for 2 hours and filtrating with a 500 mesh filter cloth, washing an obtained filter cake with 80 volume % ethanol twice, drying at 50° C. to constant weight, and pulverizing and passing through a 60 mesh sieve to obtain the modified xanthan gum.

The cross-linking agent is 3-glycidoxypropyltrimethoxysilane.

Embodiment 4

A preparing method of a fabric for sweat wicking pajamas and underclothing comprises:

(1) grey cloth weaving: blending Coolmax fiber 35 parts by weight and bamboo fiber 50 parts by weight to obtain a blended yarn, and then weaving the blended yarn and spandex 15 parts by weight with a circular loom to obtain the fabric which is a double-sided cloth with a weight of 200 g/m$^2$;

(2) singeing: singeing the grey cloth to obtain singed grey cloth through two-face-two-back singeing under the condition that a cloth speed is 90 m/min, a distance between the grey cloth and a reducing flame is 1.2 cm, a distance between the grey cloth and a copper plate is 0.6 cm, a distance between the grey cloth and a cylinder is 6 cm, and a singeing grade is 5 grades; and (3) moisture absorbing and sweat wicking finishing: immersing the singed grey cloth in a finishing liquid for 30 minutes at a temperature of 25° C. and at a mass ratio of 1:15 which is a mass ratio of the singed grey cloth to the finishing liquid, drying the singed grey cloth taken out at 100° C. for 6 minutes, baking at 150° C. for 120 seconds, washing twice at room temperature, and then drying at 70° C. to constant weight to obtain the fabric for sweat wicking pajamas and underclothing.

The finishing liquid is prepared by the following method: adding penetrating agent 0.4 parts by weight, moisture absorbing and sweat wicking finishing agent 3 parts by weight, modified xanthan gum 0.6 parts by weight, and water 96 parts by weight to the water, and stirring at 200 rpm/min and 25° C. for 10 minutes.

The penetrating agent is coconut oil diethanolamine amide.

The modified xanthan gum is prepared by the following method: obtaining neutralized acrylic acid by mixing acrylic acid 12 g and 5 mol/L sodium hydroxide solution 1.1 g and stirring at 150 rpm/min for 4 minutes, adding xanthan gum 1 g to water 140 mL, stirring at 150 rpm/min and 25° C. for 50 minutes, adding the neutralized acrylic acid, acrylamide 12 g and cross-linking agent 0.3 g, stirring at 150 rpm/min while warming to a temperature of 70° C. in a nitrogen atmosphere, adding dropwise 8 wt % potassium persulfate solution 6 g within 30 minutes, stirring at 150 rpm/min and 70° C. for 3 hours, then adding ethanol 700 mL, stirring at 60 rpm/min for 4 minutes, standing at 25° C. for 2 hours and filtrating with a 500 mesh filter cloth, washing an obtained filter cake with 80 volume % ethanol twice, drying at 50° C. to constant weight, and pulverizing and passing through a 60 mesh sieve to obtain the modified xanthan gum.

The cross-linking agent is trimethylolpropane triglycidyl ether.

Embodiment 5

A preparing method of a fabric for sweat wicking pajamas and underclothing comprises:

(1) grey cloth weaving: blending Coolmax fiber 35 parts by weight and bamboo fiber 50 parts by weight to obtain a blended yarn, and then weaving the blended yarn and spandex 15 parts by weight with a circular loom to obtain the fabric which is a double-sided cloth with a weight of 200 g/m$^2$;

(2) singeing: singeing the grey cloth to obtain singed grey cloth through two-face-two-back singeing under the condition that a cloth speed is 90 m/min, a distance between the grey cloth and a reducing flame is 1.2 cm, a distance between the grey cloth and a copper plate is 0.6 cm, a distance between the grey cloth and a cylinder is 6 cm, and a singeing grade is 5 grades;

(3) pretreatment: immersing the singed grey cloth in a pretreatment liquid for 30 minutes at a temperature of 30° C. and at a mass ratio of 1:15 which is a mass ratio of the singed grey cloth to the pretreatment liquid, drying the singed grey cloth taken out at 70° C. to constant weight to obtain a pretreatment fabric; and (4) moisture absorbing and sweat wicking finishing: immersing the pretreatment fabric in a finishing liquid for 30 minutes at a temperature of 25° C. and at a mass ratio of 1:15 which is a mass ratio of the pretreatment fabric to the finishing liquid, drying the pretreatment fabric taken out at 100° C. for 6 minutes, baking at 150° C. for 120 seconds, washing twice at room temperature, and then drying at 70° C. to constant weight to obtain the fabric for sweat wicking pajamas and underclothing.

The pretreatment liquid is prepared by the following method: mixing inorganic salt 2 parts by weight, glycine 0.3 parts by weight, acetic acid 1 part by weight and water 96.7 parts by weight, and stirring at 200 rpm/min and 30° C. for 10 minutes to obtain the pretreatment liquid.

The inorganic salt is magnesium chloride.

The finishing liquid is prepared by the following method: adding penetrating agent 0.4 parts by weight, moisture absorbing and sweat wicking finishing agent 3 parts by weight, modified xanthan gum 0.6 parts by weight, and water 96 parts by weight to the water, and stirring at 200 rpm/min and 25° C. for 10 minutes.

The penetrating agent is coconut oil diethanolamine amide.

The modified xanthan gum is prepared by the following method: obtaining neutralized acrylic acid by mixing acrylic acid 12 g and 5 mol/L sodium hydroxide solution 1.1 g and stirring at 150 rpm/min for 4 minutes, adding xanthan gum 1 g to water 140 mL, stirring at 150 rpm/min and 25° C. for 50 minutes, adding the neutralized acrylic acid, acrylamide 12 g and cross-linking agent 0.3 g, stirring at 150 rpm/min while warming to a temperature of 70° C. in a nitrogen atmosphere, adding dropwise 8 wt % potassium persulfate solution 6 g within 30 minutes, stirring at 150 rpm/min and 70° C. for 3 hours, then adding ethanol 700 mL, stirring at 60 rpm/min for 4 minutes, standing at 25° C. for 2 hours and filtrating with a 500 mesh filter cloth, washing an obtained filter cake with 80 volume % ethanol twice, drying at 50° C. to constant weight, and pulverizing and passing through a 60 mesh sieve to obtain the modified xanthan gum.

The cross-linking agent is allyl glycidyl ether.

Comparative Example 2

The second comparative example is substantially the same as the fifth example except that the pretreatment liquid is prepared by the following method: mixing glycine 0.3 parts by weight, acetic acid 1 part by weight and water 98.7 parts by weight, and stirring at 200 rpm/min and 30° C. for 10 minutes to obtain the pretreatment liquid.

Embodiment 6

A preparing method of a fabric for sweat wicking pajamas and underclothing comprises:

(1) grey cloth weaving: blending Coolmax fiber 35 parts by weight and bamboo fiber 50 parts by weight to obtain a blended yarn, and then weaving the blended yarn and spandex 15 parts by weight with a circular loom to obtain the fabric which is a double-sided cloth with a weight of 200 g/m$^2$;

(2) singeing: singeing the grey cloth to obtain singed grey cloth through two-face-two-back singeing under the condition that a cloth speed is 90 m/min, a distance between the grey cloth and a reducing flame is 1.2 cm, a distance between the grey cloth and a copper plate is 0.6 cm, a distance between the grey cloth and a cylinder is 6 cm, and a singeing grade is 5 grades;

(3) pretreatment: immersing the singed grey cloth in a pretreatment liquid for 30 minutes at a temperature of 30° C. and at a mass ratio of 1:15 which is a mass ratio of the singed grey cloth to the pretreatment liquid, drying the singed grey cloth taken out at 70° C. to constant weight to obtain a pretreatment fabric; and (4) moisture absorbing and sweat wicking finishing: immersing the pretreatment fabric in a finishing liquid for 30 minutes at a temperature of 25° C. and at a mass ratio of 1:15 which is a mass ratio of the pretreatment fabric to the finishing liquid, drying the pretreatment fabric taken out at 100° C. for 6 minutes, baking at 150° C. for 120 seconds, washing twice at room temperature, and then drying at 70° C. to constant weight to obtain the fabric for sweat wicking pajamas and underclothing.

The pretreatment liquid is prepared by the following method: mixing inorganic salt 2 parts by weight, glycine 0.3 parts by weight, acetic acid 1 part by weight and water 96.7 parts by weight, and stirring at 200 rpm/min and 30° C. for 10 minutes to obtain the pretreatment liquid.

The inorganic salt is calcium chloride.

The finishing liquid is prepared by the following method: adding penetrating agent 0.4 parts by weight, moisture absorbing and sweat wicking finishing agent 3 parts by weight, modified xanthan gum 0.6 parts by weight, and water 96 parts by weight to the water, and stirring at 200 rpm/min and 25° C. for 10 minutes.

The penetrating agent is coconut oil diethanolamine amide.

The modified xanthan gum is prepared by the following method: obtaining neutralized acrylic acid by mixing acrylic acid 12 g and 5 mol/L sodium hydroxide solution 1.1 g and stirring at 150 rpm/min for 4 minutes, adding xanthan gum 1 g to water 140 mL, stirring at 150 rpm/min and 25° C. for 50 minutes, adding the neutralized acrylic acid, acrylamide 12 g and cross-linking agent 0.3 g, stirring at 150 rpm/min while warming to a temperature of 70° C. in a nitrogen atmosphere, adding dropwise 8 wt % potassium persulfate solution 6 g within 30 minutes, stirring at 150 rpm/min and 70° C. for 3 hours, then adding ethanol 700 mL, stirring at 60 rpm/min for 4 minutes, standing at 25° C. for 2 hours and filtrating with a 500 mesh filter cloth, washing an obtained filter cake with 80 volume % ethanol twice, drying at 50° C. to constant weight, and pulverizing and passing through a 60 mesh sieve to obtain the modified xanthan gum.

The cross-linking agent is allyl glycidyl ether.

Embodiment 7

A preparing method of a fabric for sweat wicking pajamas and underclothing comprises: (1) grey cloth weaving: blending Coolmax fiber 35 parts by weight and bamboo fiber 50 parts by weight to obtain a blended yarn, and then weaving the blended yarn and spandex 15 parts by weight with a circular loom to obtain the fabric which is a double-sided cloth with a weight of 200 g/m$^2$;

(2) singeing: singeing the grey cloth to obtain singed grey cloth through two-face-two-back singeing under the condition that a cloth speed is 90 m/min, a distance between the grey cloth and a reducing flame is 1.2 cm, a distance between the grey cloth and a copper plate is 0.6 cm, a distance between the grey cloth and a cylinder is 6 cm, and a singeing grade is 5 grades;

(3) pretreatment: immersing the singed grey cloth in a pretreatment liquid for 30 minutes at a temperature of 30° C. and at a mass ratio of 1:15 which is a mass ratio of the singed grey cloth to the pretreatment liquid, drying the singed grey cloth taken out at 70° C. to constant weight to obtain a pretreatment fabric; and (4) moisture absorbing and sweat wicking finishing: immersing the pretreatment fabric in a finishing liquid for 30 minutes at a temperature of 25° C. and at a mass ratio of 1:15 which is a mass ratio of the pretreatment fabric to the finishing liquid, drying the pretreatment fabric taken out at 100° C. for 6 minutes, baking at 150° C. for 120 seconds, washing twice at room temperature, and then drying at 70° C. to constant weight to obtain the fabric for sweat wicking pajamas and underclothing.

The pretreatment liquid is prepared by the following method: mixing inorganic salt 2 parts by weight, glycine 0.3 parts by weight, acetic acid 1 part by weight and water 96.7 parts by weight, and stirring at 200 rpm/min and 30° C. for 10 minutes to obtain the pretreatment liquid.

The inorganic salt is a mixture of magnesium chloride and calcium chloride, and a mass ratio of magnesium chloride to calcium chloride is 3:1.

The finishing liquid is prepared by the following method: adding penetrating agent 0.4 parts by weight, moisture absorbing and sweat wicking finishing agent 3 parts by weight, modified xanthan gum 0.6 parts by weight, and water 96 parts by weight to the water, and stirring at 200 rpm/min and 25° C. for 10 minutes.

The penetrating agent is coconut oil diethanolamine amide.

The modified xanthan gum is prepared by the following method: obtaining neutralized acrylic acid by mixing acrylic acid 12 g and 5 mol/L sodium hydroxide solution 1.1 g and stirring at 150 rpm/min for 4 minutes, adding xanthan gum 1 g to water 140 mL, stirring at 150 rpm/min and 25° C. for 50 minutes, adding the neutralized acrylic acid, acrylamide 12 g and cross-linking agent 0.3 g, stirring at 150 rpm/min while warming to a temperature of 70° C. in a nitrogen atmosphere, adding dropwise 8 wt % potassium persulfate solution 6 g within 30 minutes, stirring at 150 rpm/min and 70° C. for 3 hours, then adding ethanol 700 mL, stirring at 60 rpm/min for 4 minutes, standing at 25° C. for 2 hours and filtrating with a 500 mesh filter cloth, washing an obtained filter cake with 80 volume % ethanol twice, drying at 50° C. to constant weight, and pulverizing and passing through a 60 mesh sieve to obtain the modified xanthan gum.

The cross-linking agent is allyl glycidyl ether.

Test Example 1

The moisture permeability of the fabric for sweat wicking pajamas and underclothing according to the examples and comparative examples is tested. The moisture permeability refers to a property of water vapor passing through a sample within a predetermined time under the condition that there is a constant vapor pressure difference between both sides of the sample.

According to the evaporation method in GB/T12704-2009, the experimental environment temperature is 20±2° C., the relative humidity is 65%±2%, the sample is a circular sample with a diameter of 7 cm, and each group includes three samples. Experimental principle: after placing a moisture permeable cup containing distilled water having a certain temperature and sealed with a cloth sample in a sealed environment having a predetermined temperature and humidity, a moisture permeability rate of the sample is calculated based on a change in the mass of the moisture permeable cup within a certain time, wherein the moisture permeability rate is a mathematic average of the moisture permeability rates of the three samples and is calculated according to the following formula:

$$\text{moisture permeability rate } MVT = \frac{24 \cdot \Delta m}{A \cdot T}$$

Wherein, MVT (g/(m$^2$·d)) is the moisture permeability rate, Δm (g) is a difference in the mass of the same experimental assembly between two weightings, A (m$^2$) is a test area of the sample, and T (h) is a test time.

The specific test results are shown in Table 1.

TABLE 1

Test result table for the moisture permeability rate of the fabric for sweat wicking pajamas and underclothing

| | moisture permeability rate (g/(m$^2$ · d)) |
|---|---|
| First Example | 1357.463 |
| Second Example | 1639.174 |
| First Comparative Example | 1526.473 |
| Third Example | 1564.517 |
| Fourth Example | 1552.684 |
| Fifth Example | 1864.961 |
| Second Comparative Example | 1702.527 |
| Sixth Example | 1806.512 |
| Seventh Example | 2036.653 |

Test Example 2

The wicking height of the fabric for sweat wicking pajamas and underclothing according to the examples and comparative examples and the wicking height thereof after washing 30 times are tested, respectively.

The wicking height test: according to FZ/T01071-2008 "Textile-Test method for capillary effect", the wicking height of the fabric for sweat wicking pajamas and underclothing is tested. In the test, a sample with a size of 30 cm×3 cm is placed in a LCK-800 capillary effect tester (Shandong Textile Research Institute Measurement and Control Equipment Development Center) according to the requirements, each group includes three samples, and the sample is tested after placed for 24 hours under a standard atmospheric condition in which the temperature is 20±2° C. and the relative humidity is 65%±3%. An average value of measured liquid level rising heights of three samples within 30 minutes is the wicking height.

The durability test method includes: based on GB/T8629-2001 "Textile-Domestic washing and drying procedures for textile testing" and FZ/T01071-2008 "Textile-Test method for capillary effect", washing the sample with a size of 2.5 cm×30 cm using 2 g/L washing powder at 40° C. for 5 minutes, rinsing with water twice, dehydrating and drying, then repeatedly washing with the above procedures in the same manner for 30 times, and finally placing at an environment having a temperature of (20±2°) C. and a relative humidity of 65%±3% for humidity controlling for 24 hours to measure the wicking height of the fabric after washing.

The specific test results are shown in Table 2.

TABLE 2

Text result table for the wicking height of the fabric for sweat wicking pajamas and underclothing

| | wicking height (cm) | wicking height after washing 30 times (cm) |
|---|---|---|
| First Example | 15.4 | 10.2 |
| Second Example | 17.1 | 14.5 |
| First Comparative Example | 16.2 | 11.3 |
| Third Example | 16.7 | 12.4 |
| Fourth Example | 16.5 | 12.1 |
| Fifth Example | 18.9 | 16.7 |
| Second Comparative Example | 17.4 | 15.0 |
| Sixth Example | 18.5 | 16.3 |
| Seventh Example | 20.5 | 18.3 |

In the second example, since the modified xanthan gum is adopted, the moisture permeability, the wicking height and the washing resistance of the fabric for sweat wicking pajamas and underclothing are superior to those in the first example. In the second example to the fourth example, since the cross-linking agent is used for preparing xanthan gum, the moisture permeability, the wicking height and the washing resistance of the fabric for sweat wicking pajamas and underclothing are superior to those in the first comparative example. In the fifth example, since the pretreatment is performed on the fabric, the moisture permeability, the wicking height and the washing resistance of the fabric for sweat wicking pajamas and underclothing are superior to those in the second example to the fourth example. This may be because that the fiber after the pretreatment becomes loose, which is beneficial to the subsequent moisture absorbing and sweat wicking finishing. Moreover, since the inorganic salt is added to the pretreatment liquid, the property of the fabric for sweat wicking pajamas and underclothing becomes better.

While certain examples have been described, these examples have been presented by way of example only, and are not intended to limit the scope of the invention. Indeed, the novel examples described herein may be embodied in a variety of other forms; furthermore, various substitutions and changes in the form of the examples described herein may be made without departing from the spirit of the invention. The accompanying claims and their equivalents are intended to cover such forms or modifications as would fall within the scope of the invention.

What is claimed is:

1. A method of preparing a fabric for sweat wicking pajamas and underclothing, comprising:

(1) grey cloth weaving by weaving 1-100 parts by weight of a sweat wicking fiber, and a balance of 0-100 parts by weight of a regenerated cellulose fiber and 0-100 parts by weight of spandex into a grey cloth with a front side and a reverse side;

(2) singeing the grey cloth to obtain a singed grey cloth by singeing the front side twice and the reverse side twice under a condition, wherein the condition is that a cloth speed is 80-100 m/min, a distance between the grey cloth and a reducing flame is 1-1.2 cm, a distance between the grey cloth and a copper plate is 0.5-0.8 cm, a distance between the grey cloth and a cylinder is 5-7 cm, and a singeing grade is 4-5 grades; and (3) moisture adsorption and sweat wicking finishing comprising immersing the singed grey cloth in a finishing liquid for 25-35 minutes at a temperature of 20-30° C., wherein a mass ratio of the singed grey cloth to the finishing liquid is 1:10 to 1:20, taking out the singed grey cloth for drying at 90-110° C. for 4-8 minutes, baking at 140-160° C. for 100-150 seconds, washing at room temperature for 1-3 times, and then drying at 60-80° C. to a first constant weight to obtain the fabric for the sweat wicking pajamas and underclothing.

2. The method of preparing the fabric for the sweat wicking pajamas and underclothing according to claim 1, wherein the finishing liquid comprises 0.2-0.6 parts by weight of a penetrating agent, 2-4 parts by weight of a moisture adsorption and sweat wicking finishing agent, 0.4-0.8 parts by weight of xanthan gum or a modified xanthan gum, and 90-100 parts by weight of water.

3. The method of preparing the fabric for the sweat wicking pajamas and underclothing according to claim 2, wherein the penetrating agent is at least one selected from the group consisting of coconut oil diethanolamine amide and isooctanol polyethenoxy ether.

4. The method of preparing the fabric for the sweat wicking pajamas and underclothing according to claim 2, wherein the modified xanthan gum is prepared by the following method: mixing 10-15 g of acrylic acid and 0.8-1.3 g of 4-6 mol/L sodium hydroxide solution to obtain a first mixed solution, and stirring the first mixed solution for 3-5 minutes to obtain neutralized acrylic acid, adding 0.8-1.2 g of the xanthan gum to 120-150 mL of water obtain a second mixed solution, stirring the second mixed solution at 20-30° C. for 40-60 minutes, adding the neutralized acrylic acid, 10-15 g of acrylamide and 0.2-0.4 g of a cross-linking agent into the second mixed solution to obtain a third mixed solution, stirring the third mixed solution while heating to a temperature of 65-75° C. in a nitrogen atmosphere, adding dropwise 4-8 g of 5-10 wt % potassium persulfate solution into the third mixed solution within 20-40 minutes to obtain a fourth mixed solution, stirring the fourth mixed solution at 65-75° C. for 2-4 hours, then adding 600-800 mL of ethanol into the fourth mixed solution to obtain a fifth mixed solution, stirring the fifth mixed solution for 3-5 minutes, putting aside the fifth mixed solution at 20-30° C. for 1-3 hours and filtrating to obtain a filter cake, washing the filter cake with 75-85 volume % ethanol for 1-3 times, drying the filter cake after the washing at 40-60° C. to a second constant weight, and pulverizing the filter cake after the drying to obtain the modified xanthan gum.

5. The method of preparing the fabric for the sweat wicking pajamas and underclothing according to claim 4, wherein the cross-linking agent is at least one selected from the group consisting of allyl glycidyl ether, 3-glycidoxypropyltrimethoxysilane and trimethylolpropane triglycidyl ether.

6. The method of preparing the fabric for the sweat wicking pajamas and underclothing according to claim 1, wherein the sweat wicking fiber is a moisture-wicking polyester fiber; and the regenerated cellulose fiber is at least one selected from the group consisting of modal fiber, lyocell fiber, bamboo fiber and cuprammonium rayon.

7. A method of preparing a fabric for sweat wicking pajamas and underclothing, comprising:

(1) grey cloth weaving by weaving 10-100 parts by weight of a sweat wicking fiber, 10-100 parts by weight of a regenerated cellulose fiber, and 0-30 parts by weight of spandex into a grey cloth with a front side and a reverse side;

(2) singeing the grey cloth to obtain a singed grey cloth by singeing the front side twice and the reverse side twice under a condition, wherein the condition is that a cloth speed is 80-100 m/min, a distance between the grey cloth and a reducing flame is 1-1.2 cm, a distance between the grey cloth and a copper plate is 0.5-0.8 cm, a distance between the grey cloth and a cylinder is 5-7 cm, and a singeing grade is 4-5 grades;

(3) pretreatment comprising immersing the singed grey cloth in a pretreatment liquid for 25-35 minutes at a temperature of 28-32° C., wherein a mass ratio of the singed grey cloth to the pretreatment liquid is 1:10 to 1:20, taking out the singed grey cloth for drying at 60-80° C. to a first constant weight to obtain a pretreatment fabric; and (4) moisture adsorption and sweat wicking finishing comprising immersing the pretreatment fabric in a finishing liquid for 25-35 minutes at a temperature of 20-30° C., wherein a mass ratio of the pretreatment fabric to the finishing liquid is 1:10 to 1:20, taking out the pretreatment fabric for drying at 90-110° C. for 4-8 minutes, baking at 140-160° C. for 100-150 seconds, washing at room temperature for 1-3 times, and then drying at 60-80° C. to a second constant weight to obtain the fabric for the sweat wicking pajamas and underclothing.

8. The method of preparing the fabric for the sweat wicking pajamas and underclothing according to claim 7, wherein the pretreatment liquid is prepared by the following method: mixing 1-3 parts by weight of an inorganic salt, 0.2-0.4 parts by weight of glycine, 0.8-1.2 parts by weight of acetic acid and 90-100 parts by weight of water to obtain a mixed solution, and stirring the mixed solution at 28-32° C. for 8-12 minutes to obtain the pretreatment liquid; and the inorganic salt is magnesium chloride and/or calcium chloride.

9. The method of preparing the fabric for the sweat wicking pajamas and underclothing according to claim 7, wherein the finishing liquid comprises 0.2-0.6 parts by weight of a penetrating agent, 2-4 parts by weight of a moisture adsorption and sweat wicking finishing agent, 0.4-0.8 parts by weight of xanthan gum or a modified xanthan gum, and 90-100 parts by weight of water.

10. The method of preparing the fabric for the sweat wicking pajamas and underclothing according to claim 7, wherein the sweat wicking fiber is a moisture-wicking polyester fiber; and the regenerated cellulose fiber is at least one selected from the group consisting of modal fiber, lyocell fiber, bamboo fiber and cuprammonium rayon.

* * * * *